US006418291B1

(12) United States Patent
Sakemi

(10) Patent No.: US 6,418,291 B1
(45) Date of Patent: Jul. 9, 2002

(54) IMAGE FORMING APPARATUS IN WHICH CARRIER IS CARRIED FROM DEVELOPING DEVICE TO CLEANING CONTAINER

(75) Inventor: Yuji Sakemi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/708,591

(22) Filed: Nov. 9, 2000

(30) Foreign Application Priority Data

Nov. 11, 1999 (JP) ..... 11-320824

(51) Int. Cl.[7] ..... G03G 15/08
(52) U.S. Cl. ..... 399/257
(58) Field of Search ..... 399/257, 358–360, 399/298, 299

(56) References Cited

U.S. PATENT DOCUMENTS 5,752,141 A 5/1998 Nishimura et al. ..... 399/227
5,752,151 A 5/1998 Inoue et al. ..... 399/350
5,937,252 A * 8/1999 Peters, Jr. et al. ..... 399/257 X

FOREIGN PATENT DOCUMENTS

| | | |
|---|---|---|
| JP | 59-100471 | 6/1984 |
| JP | 9-218575 | 8/1997 |
| JP | 10-63074 | 3/1998 |

* cited by examiner

*Primary Examiner*—William J. Royer
(74) *Attorney, Agent, or Firm*—Fitzpatrick, Cella, Harper & Scinto

(57) ABSTRACT

An image forming apparatus has an image bearing member bearing an electrostatic image thereon. A developing device develops the electrostatic image on the image bearing member by a developer having a toner and a carrier. A transferring device transfers a toner image on the image bearing member to a transferring material. A cleaning device cleans a residual toner on the image bearing member after the transfer. A carrying device carries the developer in the developing device to the cleaning device.

6 Claims, 4 Drawing Sheets

IMAGE FORMING APPARATUS IN WHICH CARRIER IS CARRIED FROM DEVELOPING DEVICE TO CLEANING CONTAINER

BACKGROUND OF THE INVENTION

1. Field of the Invention

This invention relates to an image forming apparatus such as a copier or a printer using the electrophotographic method or the electrophotographic recording method, and particularly to an image forming apparatus using a two-component developer.

2. Related Background Art

In conventional image forming apparatuses of the electrophotographic type for effecting chromatic colored image formation, a two-component developing method including a developer container; a nonmagnetic toner and a magnetic carrier are used.

The two-component developing method, as compared with the other presently proposed developing methods, has such advantages as the stability of image and the durability of the apparatus. On the other hand, the deterioration of the developer by long-term use, particularly the deterioration of the carrier, has been unavoidable and therefore, it is necessary to do the work of interchanging the developer with the long-term use of the image forming apparatus.

Some countermeasures for this problem have heretofore been proposed.

For example, according to Japanese Patent Publication No. 2-21591, in a developing apparatus for an electrophotographic copier provided with agitating means for agitating a carrier and a toner, and a developing roller which is a developer carrying member for supplying the developer agitated by the agitating means to a photosensitive body which is a latent image bearing member, a carrier supplying (replenishing) apparatus and a toner supplying apparatus are separately or integrally provided above the agitating means, and a developer overflowing portion is provided on the side wall of the housing of the developing apparatus and therefore, a fresh developer can be supplied little by little by the above-mentioned supplying apparatuses and be discharged from the above-mentioned overflowing portion, and the characteristic of the developer in the housing of the developing apparatus can be maintained constant and as a result, the quality of image of copies can also be maintained constant. Also, the developer in the housing of the developing apparatus which has become old is sequentially automatically discharged from the developer overflowing portion, and this eliminates the necessity of the cumbersome developer interchanging work of detaching the developing apparatus from the copier, taking out the old developer in the housing of the same apparatus and replenishing (refilling) the housing with a fresh developer, and thereafter mounting the developing apparatus again, and moreover the scattering of the developer is prevented and this is hygienic.

That is, the deteriorated developer (carrier) is gradually replaced by a fresh one, whereby the progress of the apparent deterioration of the carrier is stopped and the characteristic of the developer as a whole is stabilized. Thereby, the work of interchanging the developer is made unnecessary and the maintenance property is improved.

Also, a construction in which this system is combined with the construction of a rotary type developing apparatus is proposed in Japanese Patent Application Laid-Open No. 9-218575, and according to this, this rotary type developing apparatus is provided with developer supplying means for replenishing a developing device with a necessary developer. Also, any excess developer in the developing device is discharged by the utilization of a change in the acting direction of gravity by the rotation of a rotary member. By thus utilizing a movement peculiar to the rotary member, the excess developer can be discharged by simple structure.

Besides these, various systems which do not resort to the rotary type developing apparatus have been proposed, and for example, in Japanese Patent Application Laid-Open No. 10-63074.

On the other hand, in recent years the market of full color copiers and printers has been enlarged, and among various functions being required, for example, many image forming apparatuses of the tandem type having a plurality of photosensitive drums disposed for effecting multiplex transfer have been produced to provide high productivity, and seem to become one of the mainstreams of the market in the future.

In the image forming apparatus of the tandem type, however, developing apparatuses of respective colors are fixedly disposed for respective photosensitive drums, and the simple structure as proposed in Japanese Patent Application Laid-Open No. 9-218575 could not be utilized. Therefore, in the image forming apparatus of the tandem type, to adopt the method of gradually replacing the developer with a fresh one, it has been necessary to adopt a complicated construction as shown in Japanese Patent Application Laid-Open No. 10-63074. This also holds true in image forming apparatuses for forming monochromatic images.

That is, according to the prior art, in monochromatic image forming apparatuses and full color image forming apparatuses of the tandem type yielding high productivity or of various constructions which do not adopt the rotary type developing apparatus to make the most of various features, if an attempt is made to gradually automatically interchange the developer to thereby increase the maintenance property, the complication of construction has been conversely yielded, and this has led to the rise of the cost of the main body of the apparatus.

SUMMARY OF THE INVENTION

It is an object of the present invention to provide an image forming apparatus which enables a carrier in a developing device to be automatically interchanged little by little.

It is another object of the present invention to provide an image forming apparatus which enables a carrier collected from a developing device to be carried into a cleaning container.

It is still another object of the present invention to provide an image forming apparatus comprising:

- an image bearing member bearing an electrostatic image thereon;
- developing means for developing the electrostatic image on the image bearing member by a developer having a toner and a carrier;
- transferring means for transferring a toner image on the image bearing member to a transferring material;
- cleaning means for cleaning any residual toner on the image bearing member after the transfer; and
- carrying means for carrying the developer in the developing means to the cleaning means.

Further objects of the present invention will become apparent from the following description.

DESCRIPTION OF THE PREFERRED EMBODIMENTS

Some embodiments of the present invention will hereinafter be described with reference to the accompanying drawings.

First Embodiment

A first embodiment of the present invention will first be described.

Figure 1:
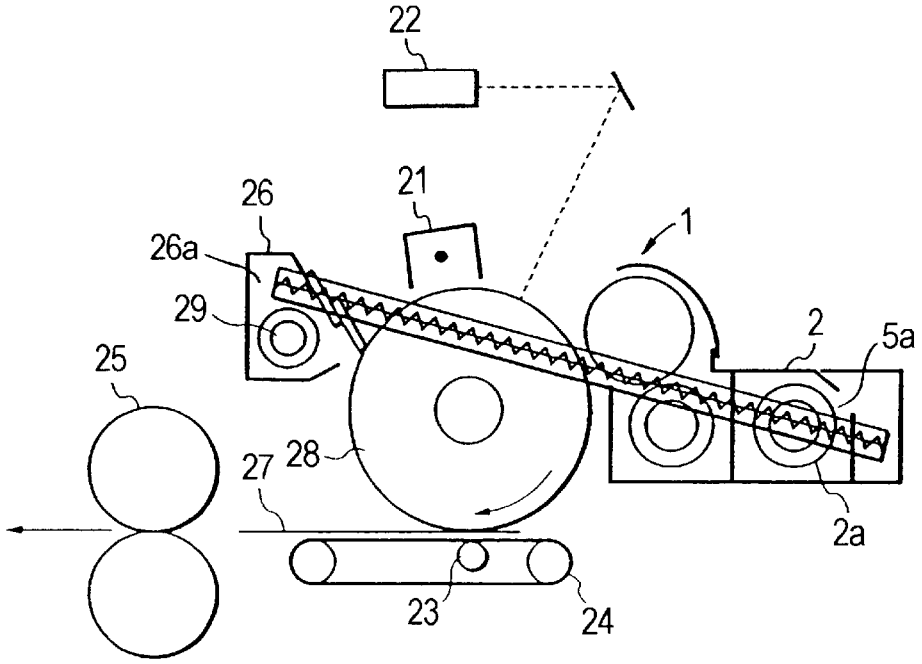
FIG. 1 is a cross-sectional view schematically showing the construction of an image forming apparatus according to a first embodiment of the present invention.
Figure 2:
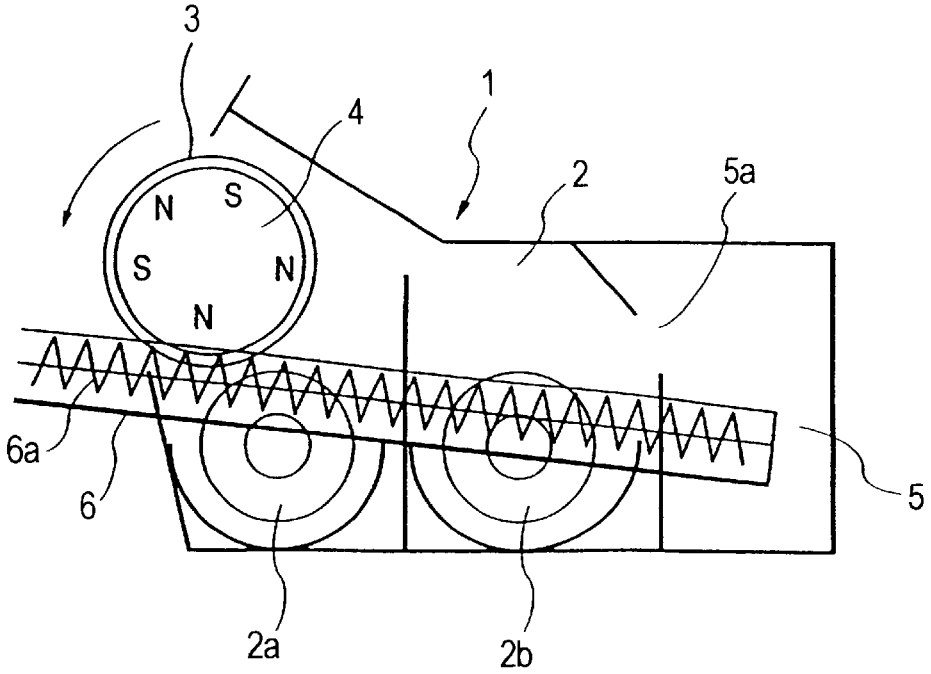
FIG. 2 is a cross-sectional view schematically showing the construction of a developing apparatus provided in the image forming apparatus of FIG. 1.
Figure 3:
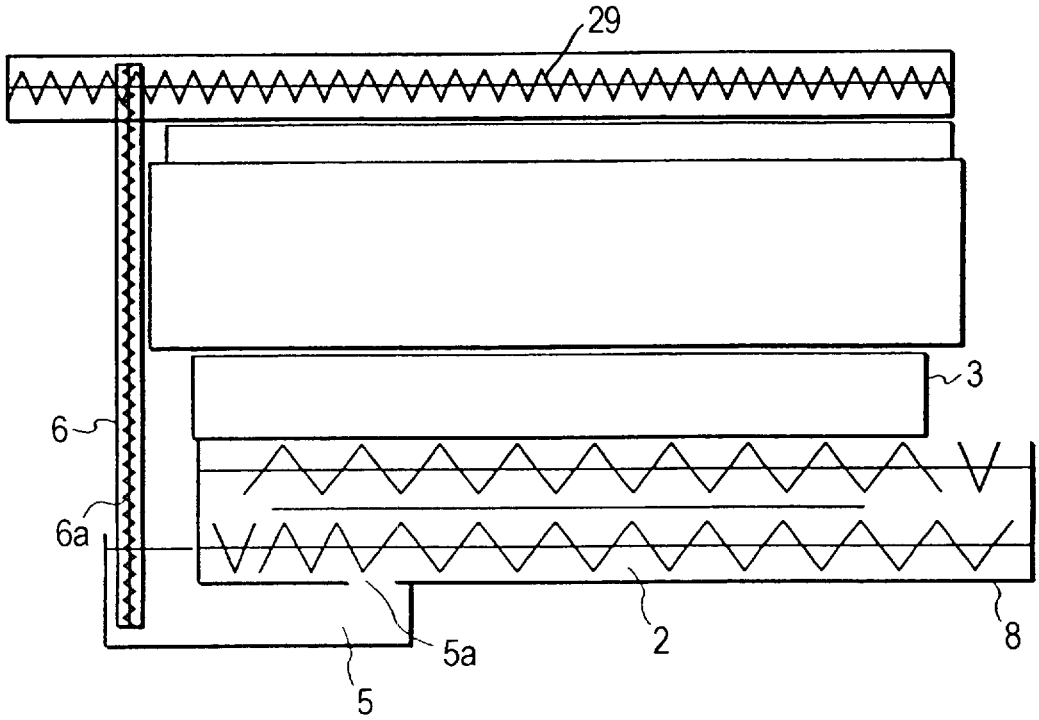
FIG. 3 is a view for illustrating the circulation of a developer in the first embodiment of the present invention in detail.
Figure 4:
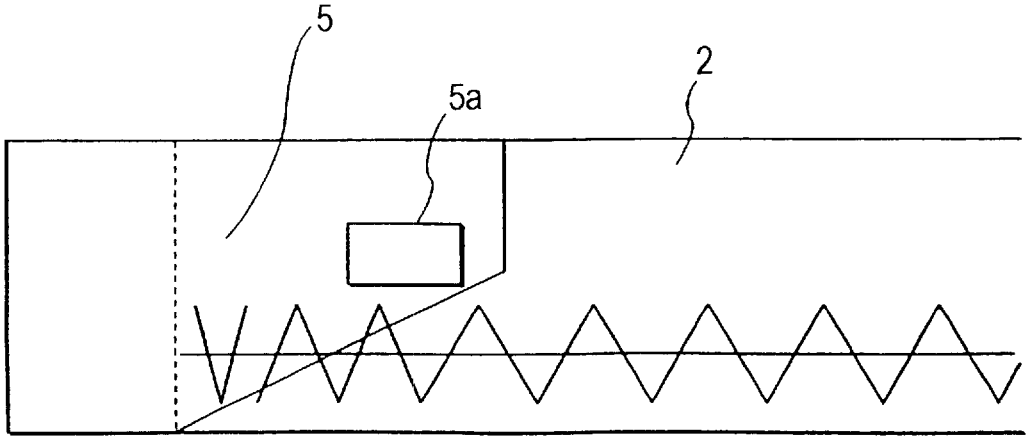
FIG. 4 is a cross-sectional view schematically showing the construction of a collecting container in the first embodiment of the present invention.

FIG. 1 is a cross-sectional view schematically showing the construction of an image forming apparatus according to the present embodiment, FIG. 2 is a cross-sectional view schematically showing the construction of a developing apparatus provided in the image forming apparatus of FIG. 1, FIG. 3 is a cross-sectional view when seen from above FIG. 1, and FIG. 4 is a cross-sectional view when seen from the rear of FIG. 1.

The general operation of such an image forming apparatus will first be described.

In such an image forming apparatus, as shown in FIG. 1, the surface of a photosensitive drum 28 which is a latent image bearing member charged by a charger 21 is first exposed by a laser 22 to thereby form an electrostatic latent image on the photosensitive drum 28, and this latent image is developed by a developing device 1 which is a developing apparatus to thereby form a toner image on the photosensitive drum 28. This toner image is transferred to recording paper or the transferring material 27 conveyed by a transferring belt 24, by a transfer bias by a transfer charger 23, where after the recording paper 27 is separated from the transferring belt 24, and is pressed and heated by a fixing device 25 to thereby obtain a permanent image. On the other hand, any residual toner remaining on the photosensitive drum 28 after the transfer is removed by cleaner means 26 which includes a cleaning container 26*a*, and the photosensitive drum 28 is ready for the next image formation.

The cleaner 26 has a carrying screw 29 therein, and the developer removed by the cleaner may be carried from the image forming portion into the main body of the apparatus. This developer is carried to a location (not shown) in the main body, and is collected at suitable timing by a serviceman or the like.

The developing device 1 will now be described in detail with reference to FIG. 2.

The developing device 1 has a developing container 2 which is a developer container, a developing sleeve 3 which is a developer carrying member, a first developer circulating screw 2*a* and a second developer circulating screw 2*b* which are agitating and carrying means, a developer collecting portion 5 and collected developer carrying means 6.

A two-component developer containing a nonmagnetic toner and a magnetic carrier is contained in the developing container 2 of the developing device 1, and the mixing ratio thereof is about 1:9 in terms of weight ratio. This ratio should be properly adjusted by the charge amount of the toner, the particle diameter of the carrier, the construction of the image forming apparatus, and need not always follow this numerical value.

Also, the developing container 2 is such that its developing area opposed to the photosensitive drum 28 opens, and the developing sleeve 3 is rotatably disposed in this opening portion in such a manner as to be partly exposed.

The developing sleeve 3 is formed of a non-magnetic material and has fixedly disposed therein a magnet 4 which is magnetic field producing means.

Also, the developing sleeve 3 is adopted to be rotated in the direction of the arrow in FIG. 2 during the developing operation, hold the two-component developer in the developing container 2 in the form of a layer, carry it to the developing area opposed to the photosensitive drum 28, and supply the two-component developer to this developing area to thereby develop the electrostatic latent image formed on the photosensitive drum 28.

The developer after having developed the electrostatic latent image is carried with the rotation of the developing sleeve 3 and is collected into the developing container 2.

The developer collected into the developing container 2 is circulated in the developing container 2 by the first developer circulating screw 2*a* (the side near to the developing sleeve 3) and the second developer circulating sleeve 3) and the second developer circulating screw 2*b* (the side far from the developing sleeve 3) and is agitated. In the present embodiment, the direction of circulation of the developer is the direction from this side of FIG. 2 toward the inner side on the first developer circulating screw 2*a* side, and is the direction from the inner side of FIG. 2 toward this side on the second developer circulating screw 2*b* side.

FIG. 2 is a cross-sectional view of the developing device 1 as it is seen from the inner side of the machine, and this side of FIG. 2 corresponds to the inner side of the main body.

The supply and collection of the developer which are the characteristic portions of the present embodiment will now be described in detail.

The developer collecting portion 5, as shown in FIG. 3, is located on the inner side of the developing device 1, and the movement of the developer between the developing container 2 and the developer collecting portion 5 is made possible by an opening portion 5*a* formed between the developing container 2 and the developer collecting portion 5.

The screw 2*b* has its pitch width made narrow near the opening portion 5*a*. By the pitch width being made narrow, the stagnation of the developer occurs near the opening portion 5*a*. In the present embodiment, a developer containing a carrier at a predetermined rate (about 10% in terms of the weight ratio) in a toner is used as the replenishment developer and therefore, if replenishment is done while the density of the toner is kept constant, the quantity of the developer in the developing container 2 increases with image formation. When the quantity of the developer increases, the developer surface in the stagnating portion rises. The opening portion 5*a* is provided near the stagnating portion and therefore, when the quantity of the developer increases, the developer will pass through the opening portion 5*a* and overflow into the developer collecting portion 5. The developer in the developer collecting portion 5 is carried to the inner side because the bottom surface of the developer collecting portion 5 becomes low on the inner side, as shown in FIG. 4. The developer carried to the inner side is carried to the upper portion of a carrying screw 29 by collected developer carrying means 6 provided with a screw 6*a* therein. The thus carried collected developer is carried from the image forming portion to a predetermined location in the main body of the apparatus by the carrying screw 29 with the developer removed by the cleaner.

The toner corresponding to an amount consumed by image formation is supplied as the replenishment developer containing the carrier at a predetermined rate as described above from above this side portion 8 of the developing container 2 in accordance with the rotation of a replenishment screw (not shown).

In this manner, the developing device 1 is replenished with the replenishment developer from a developer hopper (not shown). The mixing ratio of the toner and carrier in this replenishment developer is about 9:1 in terms of weight ratio, and is not particularly restricted to this numerical value. That is, the quantity of toner is overwhelmingly great relative to the ratio of the two-component developer in the developing container 2, and if the volume ratio is taken into consideration, it can be considered that a slight quantity of carrier is mixed with the toner. That is, when the toner consumed by image formation is to be supplemented, a slight quantity of carrier is gradually supplied. If the ratio of the carrier in the supplied toner becomes great, the amount of replacement of the carrier becomes great by the same quantity of toner supply and the two-component developer in the developing device 1 approximates to a fresh state, but correspondingly the quantity of consumed toner becomes great. Therefore, it is preferable to discretely determine the mixing ratios in respective apparatuses.

The quantity of supply of the toner (and the carrier) is roughly determined by the number of rotations of the replenishment screw, and this number of rotations in turn is determined by toner supply quantity controlling means (not shown). As toner supply quantity controlling methods, there are known various methods such as a method of optical or magnetically detecting the density of the toner of the two-component developer, and a method of developing a standard latent image on the photosensitive drum 28 and detecting the density of the toner image and therefore, it is possible to suitably select one of these methods.

The replacement of the two-component developer is gradually done in this manner.

Consequently, according to the present embodiment, again in an image forming apparatus like a monochromatic image forming apparatus in which a developing apparatus is fixedly disposed relative to a latent image bearing member, the developer can be gradually automatically interchanged by a simple construction in which a stagnating portion is provided in a portion of the developer circulation in a developing container and the developer overflowing from an opening portion formed in the developing container is collected by the utilization of the toner collecting screw of a cleaner. That is, it is possible to achieve the object of the present invention which is to realize and provide an image forming apparatus which is low in cost and high in maintenance property.

Second Embodiment

A second embodiment of the present invention will now be described. In the second embodiment, members similar to those in the first embodiment are given the same reference numerals and need not be described.

Figure 5:
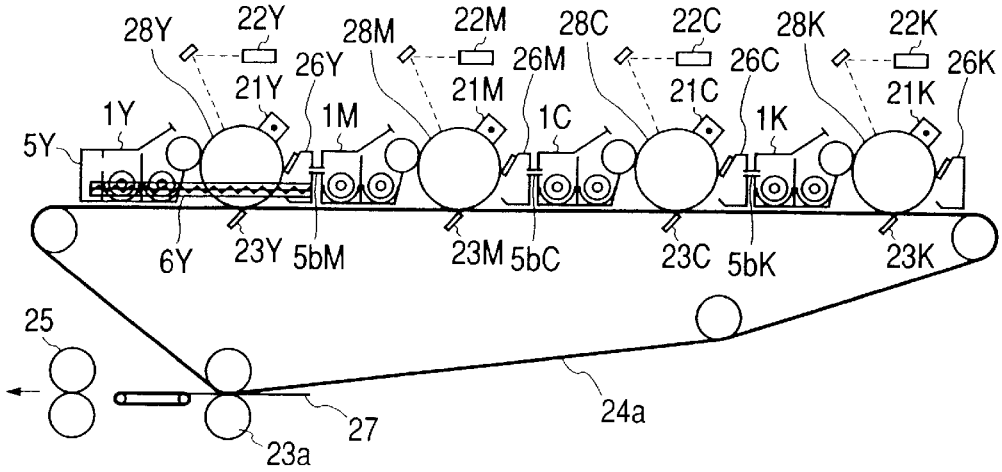
FIG. 5 is a cross-sectional view schematically showing the construction of an image forming apparatus according to a second embodiment of the present invention.

FIG. 5 is a cross-sectional view schematically showing the construction of a full color image forming apparatus which is an example of the image forming apparatus according to the present embodiment.

As shown in FIG. 5, in the image forming apparatus according to the present embodiment, a Y station, an M station, a C station and a K station for forming toner images of respective colors are arranged in a lateral direction. Yellow, magenta, cyan and black toner images formed by the respective stations are successively transferred onto an intermediate transferring belt 24*a* by the transferring chargers 23Y, M, G, K of the respective stations, and thereafter are collectively transferred onto recording paper 27 by a secondary transferring charger.

In the intermediate transferring method like that of the present embodiment, a conveying mechanism for the transferring paper 27 is simplified and therefore, it is difficult for a trouble such as paper jam to occur, and such method has the characteristic that it can easily cope with various materials such as plain paper and OHP film.

Also, another characteristic of the image forming apparatus according to the present embodiment is that the developing device for yellow is the same as the developing device in the first embodiment, but in the other stations, the developer collecting portion 5 is not provided and design is made such that the developers are directly collected from the opening portion 5*a* by the utilization of the developer collecting screw of the cleaner of the neighboring station.

Figure 6:
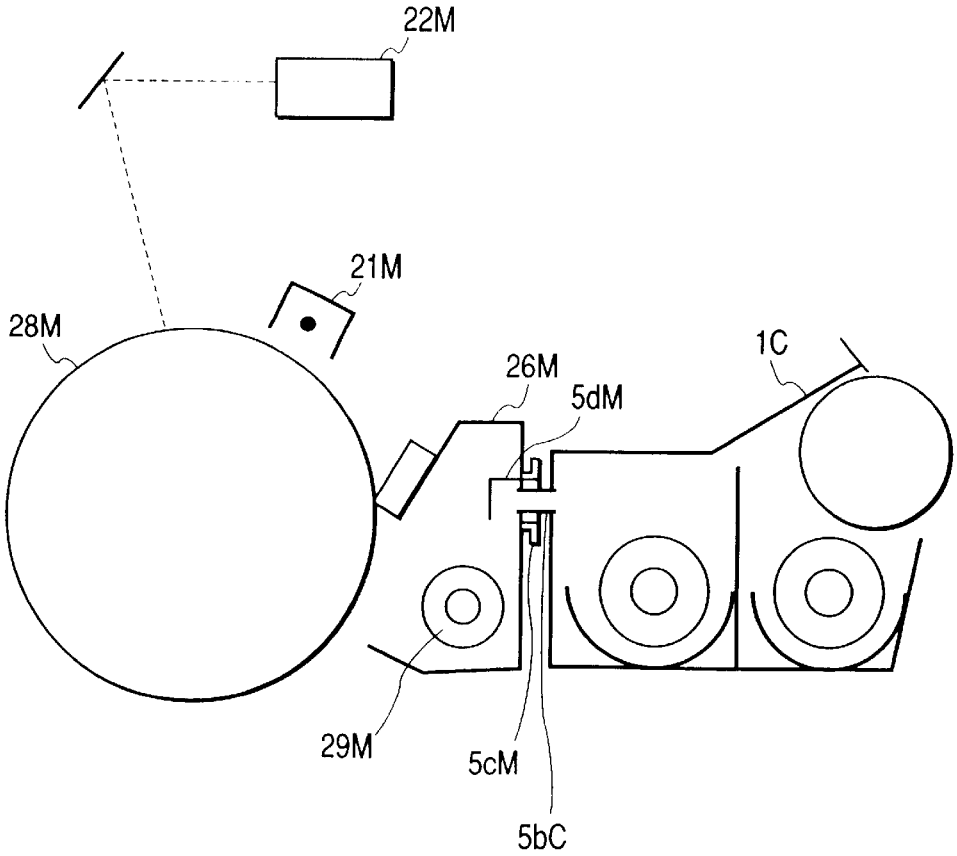
FIG. 6 is a cross-sectional view for schematically showing the construction of a developing apparatus in the second embodiment of the present invention.
Figure 7:
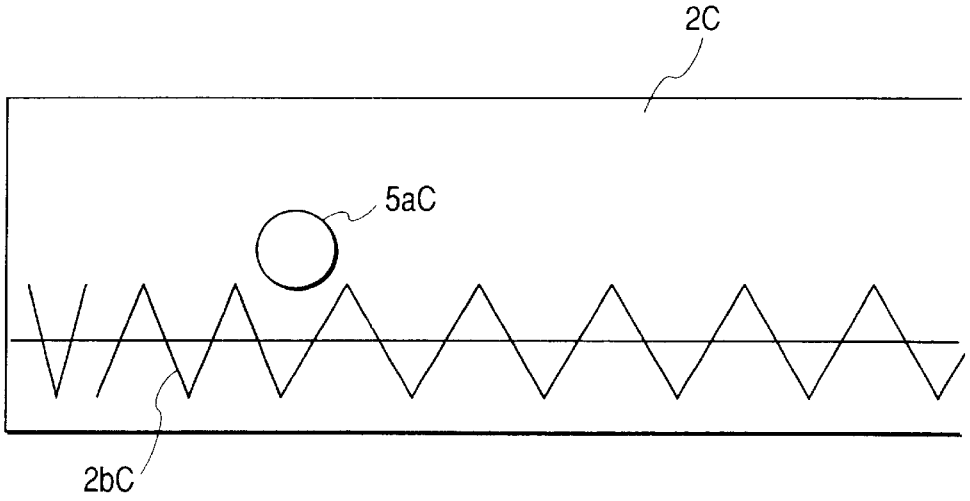
FIG. 7 is a view for illustrating the circulation of the developer in the second embodiment of the present invention in detail.

A method of collecting the cyan developer will hereinafter be described as an example with reference to FIG. 6.

The screw 2*b*C of a developing device 1C which is a developing apparatus for cyan also has its pitch changed near an opening portion of a cleaning container 5*a*C so that the stagnation of the developer may occur in the opening portion 5*a*C. The opening portion 5*a*C is circular and has projected portion 5*b*C. The projected portion 5*b*C is adapted to be also inserted into the portion 5*c*M of the cleaner 26M of the neighboring station when the developing device 1C is inserted into the main body. The portion 5CM is cylindrically shaped and has a sponge member such as poron or moltopren on the inner surface thereof, and is designed such that after a cleaner 26M and the developing device 1C are coupled together, the developer or the toner does not leak from a developer delivering portion. As described in the first embodiment, when the developer in the developing device 1C increases, the developer surface rises in the stagnating portion. The developer which has risen falls from the opening portion 5*a*C onto a cleaning developer collecting screw 29M through the projected portion 5*b*C, and is discharged out of the image forming portion with the developer collected by the cleaner 26M.

In a construction like that of the present embodiment, neither the developer collecting portion used in the first embodiment nor the screw for carrying the developer from the collecting portion to the cleaning portion is required and the main body of the image forming apparatus does not become bulky.

Consequently, according to the present embodiment, not only is it possible to achieve the object of the present invention which is to realize and provide an image forming apparatus which is low in cost and high in maintenance property, but also the entire apparatus can be made compact by making the most of the high productivity which is the characteristic of a tandem type full color image forming apparatus and the stability of the conveyance of transferring paper and the capability of coping with transferring materials which are the characteristics of the intermediate transferring method, and efficiently utilizing the conveying means of the neighboring cleaner.

Third Embodiment

A third embodiment of the present invention will now be described. In the third embodiment, members similar to those in the first embodiment or the second embodiment are given the same reference numerals and need not be described.

Figure 8:
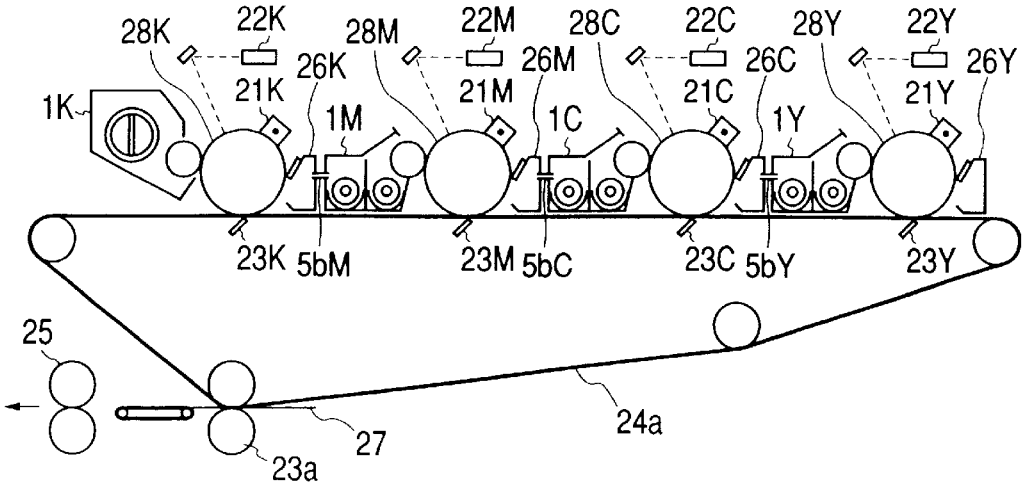
FIG. 8 is a cross-sectional view schematically showing the construction of an image forming apparatus according to a third embodiment of the present invention.

As shown in FIG. 8, in an image forming apparatus according to the present embodiment, a K station, an M station, a C station and a Y station for forming toner images of respective colors are arranged in a lateral direction. The black, magenta, cyan and yellow toner images formed by the respective stations are successively transferred onto an intermediate transferring belt 24*a* by transferring chargers 23K, 23M, 23C, 23Y of the respective stations, and thereafter are collectively transferred onto recording paper 27 by a secondary transferring charger 23*a*. The present embodiment is the same as the second embodiment with the exception that one-component magnetic development (jumping development) is used for the first color.

Consequently, in the present embodiment, since one-component development is used for the first color and the interchange of the developer is not required, the developer collecting portion and the screw for carrying the developer from the developer collecting portion to the cleaning portion which were necessary in the first embodiment and the second embodiment are not required, and there can be realized a lower-cost, compact, long-life and stable image forming apparatus of the 4D type.

While the image forming apparatus of the present invention has been described in the first to third embodiments, the present invention is not restricted to the above-mentioned constructions but various constructions can be adopted in accordance with the proposition of the present invention.

What is claimed is:

1. An image forming apparatus comprising:

an image bearing member bearing an electrostatic image thereon;

developing means for developing the electrostatic image on said image bearing member by a developer having a toner and a carrier;

transferring means for transferring a toner image on said image bearing member to a transferring material;

cleaning means for cleaning a residual toner on said image bearing member after the transfer; and carrying means for carrying the developer in said developing means to said cleaning means.

2. An image forming apparatus according to claim 1, further comprising discharging means for discharging the developer in said cleaning means.

3. An image forming apparatus according to claim 1, wherein said carrying means carries the carrier to said cleaning means.

4. An image forming apparatus according to claim 1, wherein said cleaning means has a cleaning container for containing the residual toner subjected to the cleaning therein, and said carrying means carries the developer into the cleaning container.

5. An image forming apparatus according to claim 1, wherein said developing means has agitating and carrying means for agitating and carrying the developer, and collects the developer from an opening provided in a portion of said agitating and carrying means in the carrying direction thereof.

6. An image forming apparatus according to claim 5, wherein said agitating and carrying means is constituted such that the developer stagnates at a location corresponding to the opening.

* * * * *

UNITED STATES PATENT AND TRADEMARK OFFICE

CERTIFICATE OF CORRECTION

PATENT NO. : 6,418,291 B1
DATED : July 9, 2002
INVENTOR(S) : Yuji Sakemi

It is certified that error appears in the above-identified patent and that said Letters Patent is hereby corrected as shown below:

Title page,
Item [56], References Cited, "5,752,141" should read -- 5,572,151 --.

Column 1,
Line 18, "container;" should read -- containing --.

Column 2,
Line 10, "example," should read -- example, a developing apparatus as shown in Fig. 9 of the accompanying drawings is proposed --.

Column 3,
Line 56, "or the transferring material 27" should read -- 27 or the transferring material --; and
Line 59, "where after" should read -- whereafter --.

Column 4,
Line 43, "sleeve 3) and" should be deleted; and
Line 44, "the second developer circulating" should be deleted.

Column 5,
Line 44, "to" should be deleted; and
Line 66, "be gradually automatically" should read -- gradually automatically be --.

UNITED STATES PATENT AND TRADEMARK OFFICE

CERTIFICATE OF CORRECTION

PATENT NO. : 6,418,291 B1
DATED : July 9, 2002
INVENTOR(S) : Yuji Sakemi

It is certified that error appears in the above-identified patent and that said Letters Patent is hereby corrected as shown below:

Column 6,
Line 25, “G,” should read -- C, --;
Line 31, “trouble” should read -- problem --;
Line 51, “be also” should read -- also be --; and
Line 53, “5CM” should read -- 5cM --.

Signed and Sealed this

Fourteenth Day of January, 2003

JAMES E. ROGAN
*Director of the United States Patent and Trademark Office*